US010035250B2

(12) United States Patent
Kaindlbauer

(10) Patent No.: US 10,035,250 B2
(45) Date of Patent: Jul. 31, 2018

(54) CONTROL OF THE WORKING FREQUENCY OF AN IMPACT MECHANISM

(71) Applicant: TMT-BBG RESEARCH AND DEVELOPMENT GMBH, Kapfenberg (AT)

(72) Inventor: Stefan Kaindlbauer, Strallegg (AT)

(73) Assignee: TMT-BBG RESEARCH AND DEVELOPMENT GMBH, Kapfenberg (AT)

( * ) Notice: Subject to any disclaimer, the term of this patent is extended or adjusted under 35 U.S.C. 154(b) by 882 days.

(21) Appl. No.: 14/196,378

(22) Filed: Mar. 4, 2014

(65) Prior Publication Data

US 2014/0290971 A1 Oct. 2, 2014

(30) Foreign Application Priority Data

Mar. 4, 2013 (AT) ..... A 50139/2013

(51) Int. Cl.

| | |
|---|---|
| ***B25D 9/26*** | (2006.01) |
| ***C21B 7/12*** | (2006.01) |
| ***F27D 3/15*** | (2006.01) |
| ***B25D 9/18*** | (2006.01) |
| ***C21C 5/46*** | (2006.01) |

(52) U.S. Cl.

CPC ..... *B25D 9/26* (2013.01); *B25D 9/18* (2013.01); *C21B 7/12* (2013.01); *C21C 5/4653* (2013.01); *F27D 3/1527* (2013.01)

(58) Field of Classification Search

CPC . B25D 9/145; B25D 9/18; B25D 9/14; B25D 9/26

USPC ..... 173/1, 13, 14, 91

See application file for complete search history.

(56) References Cited

U.S. PATENT DOCUMENTS

| | | | | |
|---|---|---|---|---|
| 3,741,316 A * | 6/1973 | Alajouanine | ..... | B25D 9/12 173/107 |
| 3,790,125 A * | 2/1974 | Swatty | ..... | F16K 11/0716 137/624.27 |
| 3,965,799 A | 6/1976 | Juvonen et al. | | |
| 4,006,783 A * | 2/1977 | Granholm | ..... | B25D 9/145 173/105 |

(Continued)

FOREIGN PATENT DOCUMENTS

| | | |
|---|---|---|
| AT | 511 810 | 3/2013 |
| DE | 2443800 | 3/1975 |

(Continued)

OTHER PUBLICATIONS

Austria Office Action conducted in counterpart Austria Appln. No. A 50139/2013 (Sep. 11, 2013).

(Continued)

*Primary Examiner* — Nathaniel Chukwurah

(74) *Attorney, Agent, or Firm* — Greenblum & Bernstein, P.L.C.

(57) ABSTRACT

Control device of an impact mechanism operable by a pressure media having an element for reversing the axial pressurization of the percussion piston and the return of the medium. In order to achieve a controllability of impact mechanisms by which the energy and the frequency of the moved percussion piston can be adjusted, at least one channel switchable by the reversal as a return line for the medium from the percussion hammer has at least one switchable element for the flow control.

16 Claims, 2 Drawing Sheets

(56) References Cited

U.S. PATENT DOCUMENTS

| | | | | |
|---|---|---|---|---|
| 4,026,193 | A * | 5/1977 | Olmsted | B06B 1/183 137/596.14 |
| 4,056,123 | A * | 11/1977 | Kimura | B06B 1/183 137/624.14 |
| 4,084,486 | A | 4/1978 | Juvonen | |
| 4,342,255 | A | 8/1982 | Watanabe et al. | |
| 4,343,227 | A | 8/1982 | Karru et al. | |
| 5,143,115 | A * | 9/1992 | Geyler, Jr. | F16K 17/18 137/454.5 |
| 5,890,548 | A | 4/1999 | Juvonen | |
| 5,979,291 | A | 11/1999 | Juvonen | |
| 6,209,659 | B1 * | 4/2001 | Blessing | B25D 9/04 173/109 |
| 8,118,112 | B2 * | 2/2012 | Juvonen | B25D 9/145 137/625.25 |
| 8,251,097 | B2 * | 8/2012 | Drumm | F15B 13/0402 137/625.68 |
| 2013/0075120 | A1 | 3/2013 | Schantl et al. | |

FOREIGN PATENT DOCUMENTS

| | | |
|---|---|---|
| DE | 2628397 | 12/1976 |
| DE | 3023610 | 1/1981 |
| EP | 0 752 297 | 1/1997 |
| EP | 0 930 476 | 1/1999 |

OTHER PUBLICATIONS

European Search Report conducted in counterpart European Appln. No. 14 15 4964.2-1603 (Jul. 14, 2014).

* cited by examiner

CONTROL OF THE WORKING FREQUENCY OF AN IMPACT MECHANISM

CROSS-REFERENCE TO RELATED APPLICATIONS

The present application claims priority under 35 U.S.C. §119 of Austrian Patent Application No. A 50139/2013, filed Mar. 4, 2013, the disclosure of which is expressly incorporated by reference herein in its entirety.

BACKGROUND OF THE INVENTION

1. Field of the Invention

Embodiments of the invention relate to control of an impact mechanism operable by a pressure medium having an element for reversing the axial pressurization of the percussion piston and the return of the medium.

Furthermore, embodiments relate to an impact mechanism for a device for opening and, possibly, for closing a tapping hole in the wall of a metallurgical vessel.

2. Discussion of Background Information

Impact mechanisms for a hammer device axially usable in both directions are known and are part of the prior art.

Advantageously, these impact mechanisms are used in devices for opening and/or closing a tapping hole in a metallurgical vessel.

EP 0930476 A, the disclosure of which is expressly incorporated by reference herein in its entirety, discloses, for example, an impact mechanism having a tubular piston in a hammer device for the above field of use. The same impact energy and impact frequency is thereby essentially applied to the tool in driving and also in retraction during a use.

In order to be able to change the impact frequency and the impact force of the piston of an impact mechanism in both directions, it was recommended according to AT 1397/2011, the disclosure of which is expressly incorporated by reference herein in its entirety, to provide a control recess in the tubular piston and at least two control grooves axially offset in the impact mechanism housing for a reversing of the pressurization of the respective pressure surfaces of the tubular piston and to alternately activate the reversing grooves by a control element. In this manner, it is achieved that the tubular piston executes a different displacement distance or acceleration distance in both impact directions depending on the activation of a reversing groove offset in an axial direction.

Particular challenges for the driving conditions and retracting conditions for tools, in particular of devices in the steel and iron industry, are currently posed by advanced demands for an impact mechanism regarding a controllability of the piston movement.

SUMMARY OF THE INVENTION

Embodiments of the invention improve or expand the controllability of impact mechanisms and create a control device by which the energy and the frequency of the moved percussion piston can be adjusted within broad limits.

Accordingly, a control of an impact mechanism of the type named at the outset operable by a pressure medium is attained in that at least one channel switchable by the reversal as a return line for the medium from the percussion piston has at least one switchable element for flow control.

The advantages attained by the invention can essentially be seen in that the return flow of the medium moving the piston occurs in a quantity-controlled manner following a reversal. By way of, for example, different outlet openings of a switching element which can be alternately activated in the return line, the backpressure of the medium toward the reversal can be changed so that the length of time until the subsequent pressurization of the percussion hammer can be changed. In this manner, the impact force and, in particular, the impact frequency can be controlled, wherein a delayed reversal also influences the impact energy.

A change in the flow quantity per unit of time in the return line or a flow control in this return line can be achieved in a simple manner, for example, by a switchable element with narrow positions in the flow channel which have different cross sections.

A flow-quantity control or a pressure trend over time occurs in the return line of the unstressed medium, which changes the frequency and, consequentially, the energy or the intensity of the impacts of the piston.

For an advantageously universal controlling behavior in both impact directions of the impact mechanism, both channels switchable by the reversal as a return line for the medium from the percussion piston can have switchable elements for flow control.

In this manner, the switchable element can control the impact mechanism in each work direction and respectively optimally adjust the tool impact of a device differently.

It can thereby be advantageous if the switchable elements for flow control for the medium can be adjusted separately from one another.

A previously described control device can, in an optimal manner, satisfy essentially all demands which are placed on an impact mechanism in a hard use.

Particularly advantageously, a control according to the invention of the type described can be used for a device for opening and/or closing a tapping hole of a metallurgical vessel.

The control offers the possibility, considering the brittle and fragile, fireproof lining substances of a metallurgical vessel, of creating optimal conditions for an opening of a tapping hole in a vessel for molten material.

Embodiments of the invention are directed to a control device of an impact mechanism operable by a pressure medium. The control device includes a reversal element structured and arranged for reversing an axial pressurization of a percussion piston and a return of the pressure medium. At least one channel switchable by the reversal part to a return line for the medium from the percussion hammer has at least one switchable element for flow control.

In embodiments, the at least one channel can include two channels. Both channels can be switchable by the reversal part as a return line for the medium from the percussion piston, and each channel may include switchable elements for flow control. The switchable elements for flow control for the medium can be adjustable separately from one another.

According to embodiments, a method of using the above-described control device of an impact mechanism includes controlling a pressure medium flow in a device for at least one of opening and closing a tapping hole of a metallurgical vessel.

Embodiments of the invention are directed to a control device for an impact mechanism. The control device includes a housing having first and second axial ends and a reversal part arranged in the housing for limited axial movement. The reversal part is positionable within the housing to open paths for a flow of a pressure medium or a return flow of the medium to or from the impact mechanism.

According to embodiments, the control device may further include a switching insert located on the first axial end, a control medium feed coupled to the switching insert to supply a control medium, a switching element arranged in the switching insert for limited axial displacement and a spring arranged in the switching insert to act on one side of the switching element. The switching insert can include at least one pressure surface arranged to be acted upon by the control medium to force the switching element against a force of the spring.

In accordance with other embodiments, the control device may further include a first channel, through which a pressure medium is conducted, coupled to a side of a piston in the impact mechanism and a second channel, through which a pressure medium is conducted, coupled to an opposite side of the piston. In a first position of the reversal part, the pressure medium can flow through the first channel to the side of the piston, and the pressure medium can flow from the opposite side of the piston to return to the housing through the second channel. The switching element may include an element for flow control. The flow control can be structured and arranged to control a return flow of the pressure medium or a length of time up to which a pressure in the second channel is decreased for displacement of the reversal part to a second position. In the second position of the reversal part, the pressure medium can return from the one side of the piston to the housing, and the pressure medium can flow to the opposite side of the piston through the second channel.

In accordance with still yet other embodiments of the present invention, the switching element can be structured and arranged to be slidably received in the reversal part. A force of the spring can slide the switching element into the reversal part. Further, the sliding of the switching element in the reversal part may be controlled by increasing or decreasing a pressure of a control medium. Upon increasing the pressure of the control medium, the switching element can slide into the reversal part. Still further, upon decreasing the pressure of the control medium, the switching element may slide out of the reversal part.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
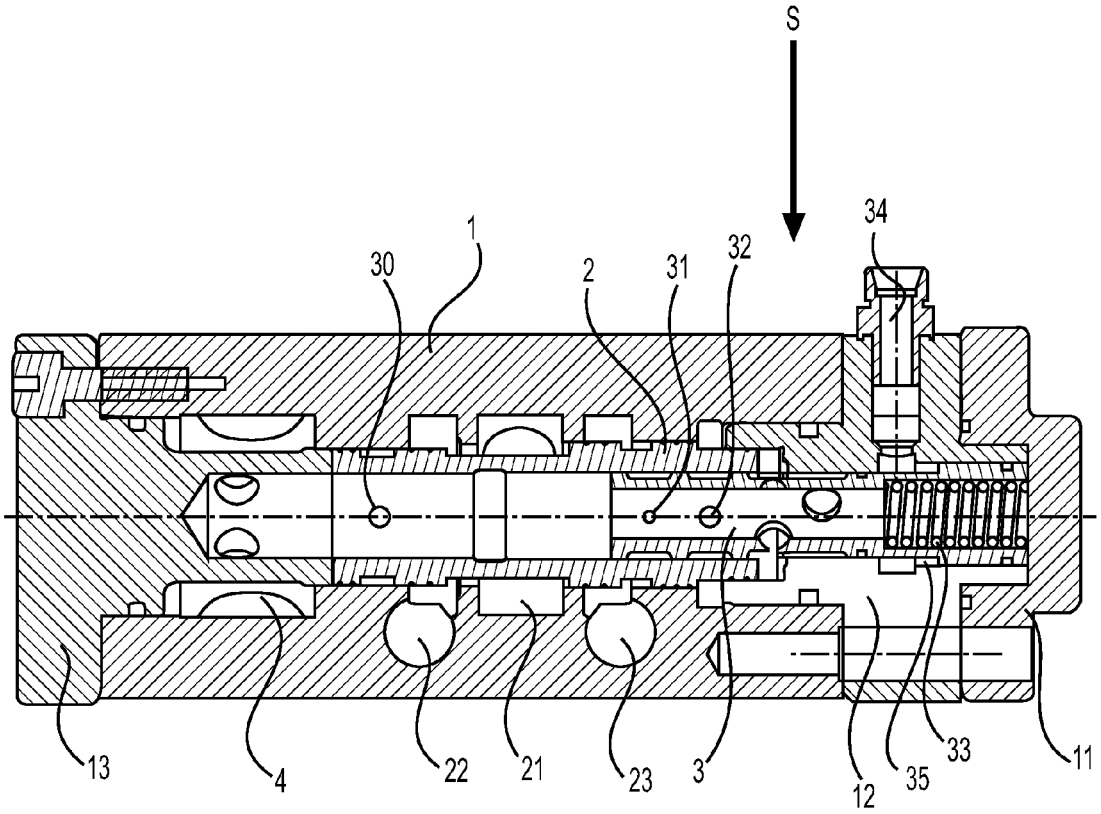
FIG. 1 shows a control device with a flow control positioned in a return line.

FIG. 1 shows a control device S having a housing 1 which has on both sides in an axial direction a cover 13, 11. Cover 13 has a protruding insert and is used as a medium discharge 4.

Opposing cover 11 acts as a fixture for a switching insert 12 having a control medium feed 34. In the switching insert 12, a tubular switching element 3, which is arranged to be axially displaceable within limits, is acted on axially on one side with a pressure force by a spring 33 braced against cover 11 and on the other side with a pressure medium acting on a pressure surface 35 on the switching element 3 directed against the spring force. The pressure medium can be introduced via control medium feed 34 and displace switching element 3 against the spring force. Switching element 3, which extends into the cavity of the reversing part 2, can be positioned in this manner.

Reversal part 2 is arranged in housing 1 to be axially movable within limits, and radial limit surfaces on the insert of cover 13 and on switching insert 12 serve respectively to position reversal part 2.

The inner surface in housing 1 and the outer surface of reversing part 2 have recesses which, depending on the axial position of reversal part 2, open paths for a flow of the pressure medium or a return flow of the medium to or from the impact mechanism, respectively.

In the illustration according to FIG. 1, reversal part 2 is located at the limit on cover 13.

An infeed space 21 for the pressure medium is connected to a channel 22 so that this pressure medium impinges on a side of a piston in the impact mechanism.

From the opposite side of the piston, a return of the medium into housing 1 through a channel 23 occurs, and this medium is conducted into an external space of switching element 3 through a hole in reversal part 2 (not illustrated) and subsequently centrally transported to the medium discharge by an element 31 in switching element 3 or flow control.

Element 31 for flow control controls the return flow of the media or the length of time up to which the pressure in return feed channel 23 is decreased far enough so that a displacement of reversal part 2 against the radial pressure surface of switching insert 12 occurs by the pressure medium. The return flow path is thus switched off and channel 23 for conducting the pressure media is converted into the percussion piston.

At the same time, the displacement of reversal part 2 produces an interruption of the infeed of the pressure medium and a switching of channel 22 as a return feed line for the medium, which is conducted to media discharge 4 via the recess and by a hole 30 in reversal part 2.

If switching element 3 is now slid into reversal part 2 by an activation of spring 33 or a reduction of the pressure of the control medium axially toward switching element 3, then a changed backpressure or a different outflow quantity of the medium per unit of time into the medium discharge operates via the surface recess on switching element 3 and element 32 for flow control. In this way, the point in time of the reversal of the pressure medium onto the respective pressure surfaces of the piston is changed.

Because the return feed of the medium from channel 22 toward media discharge 4 through a hole 30 in reversal part 2 now occurs in an unaffected manner during a subsequent reversal, the energy of the impact mechanism remains the same or cannot be changed in one direction.

Figure 2:
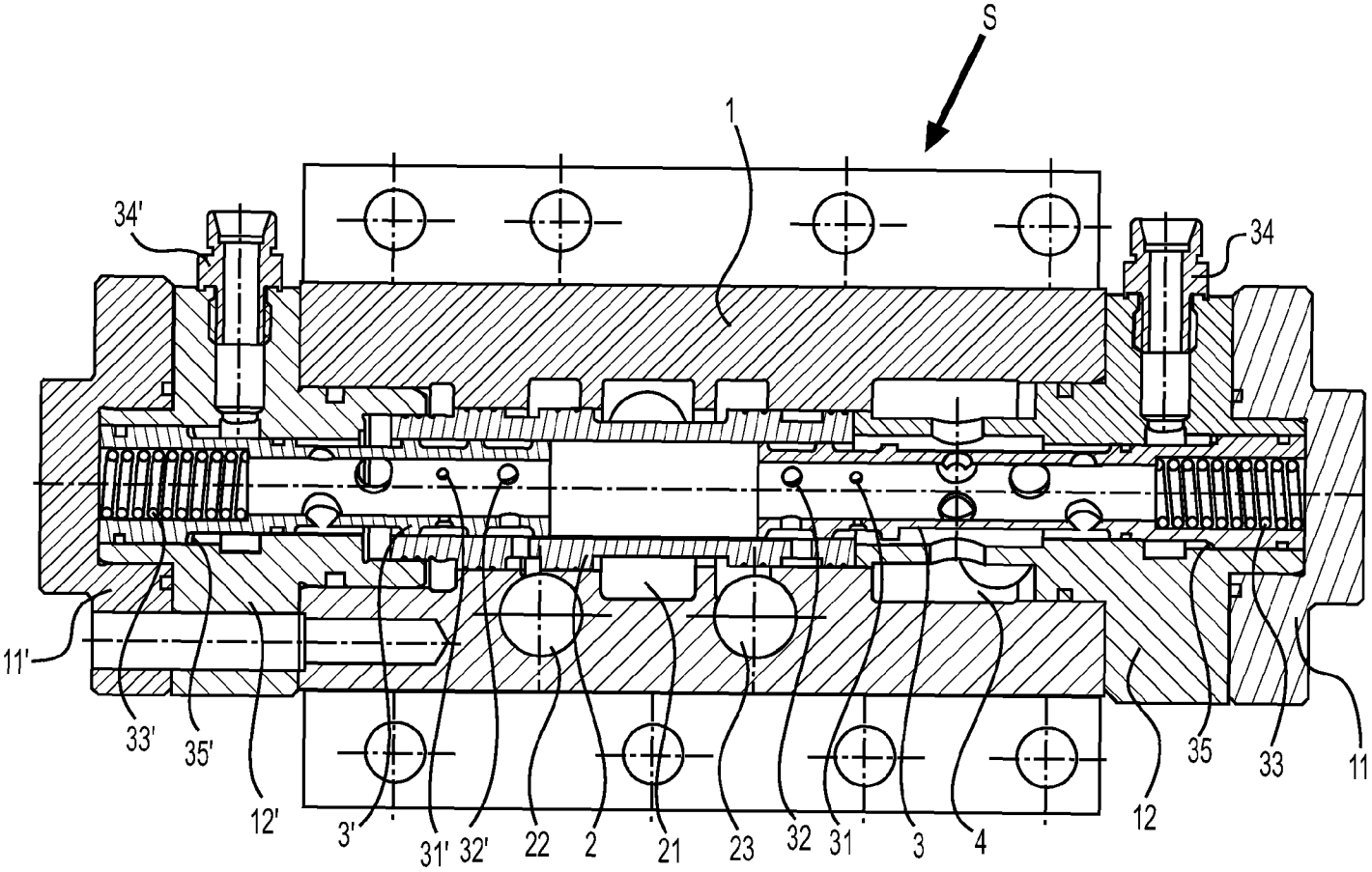
FIG. 2 shows a universally usable control device for moving a percussion piston.

A universally usable control device for a movement of a percussion piston is shown in FIG. 2.

Essentially, this universally usable control device is symmetrically structured and has, in comparison with FIG. 1, switching inserts 12, 12' structured in centrally-symmetrically similar manner with switching element 3, 3'.

From the description of FIG. 1, a person skilled in the art can derive the principle of operation of a universally usable control device according to FIG. 2.

The advantage of the control device illustrated in FIG. 2 is a universally controllable feed of a piston in an impact mechanism and, thus, a furthest possible adjustment of the intensity and the frequency of impact mechanisms, possibly operating in both axial directions, of a hammer device.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

S control device
1 housing
11, 11', 13 cover
12, 12' switching insert
2 reversal part
21 infeed space for pressure medium
22 switchable channel in the housing
23 switchable channel in the housing
3, 3' switching element
31, 31' element for flow control
32, 32' element for flow control
33, 33' compression spring
34, 34' control medium feed
35, 35' pressure surface
4 medium discharge

What is claimed:

1. A control device of a percussion hammer operable by a pressure medium, comprising:

a reversal part structured and arranged for reversing an axial pressurization of a percussion piston and a return of the pressure medium, wherein at least one channel switchable by the reversal part to a return line for the medium from the percussion hammer has at least one switchable element for flow control that is axially displaceable within the reversing part, and wherein the at least one channel comprises two channels, and wherein both channels are switchable by the reversal part as a return line for the medium from the percussion piston, and each channel includes switchable elements for flow control.

2. The control device according to claim 1, wherein the switchable elements for flow control for the medium are adjustable separately from one another.

3. A method of using a control device of an impact mechanism according to claim 1, the method comprising:

controlling a pressure medium flow in a device for at least one of opening and closing a tapping hole of a metallurgical vessel.

4. A control device for an impact mechanism comprising:

a housing having first and second axial ends; and a reversal part arranged in the housing for limited axial movement and positionable within the housing to open paths for a flow of a pressure medium or a return flow of the medium to or from the impact mechanism; and a switching element that extends into a cavity in the reversal part.

5. The control device according to claim 4, further comprising:

a switching insert located on the first axial end;

a control medium feed coupled to the switching insert to supply a control medium;

and a spring arranged in the switching insert, wherein the switching element is arranged in the switching insert for limited axial displacement and the spring is arranged to act on one side of the switching element.

6. The control device according to claim 5, wherein the switching insert comprises at least one pressure surface arranged to be acted upon by the control medium to force the switching element against a force of the spring.

7. The control device according to claim 5, wherein the switching element is structured and arranged to be slidably received in the reversal part.

8. The control device according to claim 7, wherein a force of the spring slides the switching element into the reversal part.

9. The control device according to claim 7, wherein the sliding of the switching element in the reversal part is controlled by increasing or decreasing a pressure of a control medium.

10. The control device according to claim 9, wherein, upon increasing the pressure of the control medium, the switching element slides into the reversal part.

11. The control device according to claim 9, wherein, upon decreasing the pressure of the control medium, the switching element slides out of the reversal part.

12. The control device according to claim 4, further comprising:

a first channel, through which a pressure medium is conducted, coupled to a side of a piston in the impact mechanism; and a second channel, through which a pressure medium is conducted, coupled to an opposite side of the piston.

13. The control device according to claim 12, wherein in a first position of the reversal part, the pressure medium flows through the first channel to the side of the piston, and the pressure medium flows from the opposite side of the piston to return to the housing through the second channel.

14. The control device according to claim 13, the switching element comprising an element for flow control.

15. The control device according to claim 14, wherein the flow control is structured and arranged to control a return flow of the pressure medium or a length of time up to which a pressure in the second channel is decreased for displacement of the reversal part to a second position.

16. The control device according to claim 15, wherein in the second position of the reversal part, the pressure medium returns from the one side of the piston to the housing, and the pressure medium flows to the opposite side of the piston through the second channel.

* * * * *